US005544369A

United States Patent [19]

Roberts

[11] Patent Number: 5,544,369

[45] Date of Patent: Aug. 13, 1996

[54] PORTABLE SHOWER/MULTI USE STALL

[76] Inventor: Ralph J. Roberts, 2281 Shetland Rd., Livermore, Calif. 94550

[21] Appl. No.: 126,359

[22] Filed: Sep. 16, 1994

[51] Int. Cl.[6] ..... A47K 3/23

[52] U.S. Cl. ..... 4/599; 4/603; 4/605

[58] Field of Search ..... 4/599, 602, 603

[56] References Cited

U.S. PATENT DOCUMENTS

| | | | |
|---|---|---|---|
| 2,544,092 | 3/1951 | Karlson | 4/602 |
| 3,391,409 | 7/1968 | Gatley | 4/599 X |
| 3,606,618 | 9/1971 | Veech | 4/603 |
| 3,629,875 | 12/1971 | Dow | 4/599 |
| 3,657,746 | 4/1972 | Downey | 4/599 |
| 4,413,363 | 11/1983 | Troiano | 4/603 X |
| 4,453,280 | 6/1984 | Greenleaf | 4/603 X |
| 4,539,720 | 9/1985 | Westerweller | 4/596 X |
| 4,975,992 | 12/1990 | Patterson et al. | 4/603 X |

FOREIGN PATENT DOCUMENTS

| | | | |
|---|---|---|---|
| 1602191 | 11/1981 | United Kingdom | 4/602 |

*Primary Examiner*—Robert M. Fetsuga
*Attorney, Agent, or Firm*—James J. Leary; Carol D. Titus

[57] ABSTRACT

A portable shower system which when disassembled is stored in its own base, to define a suitcase-like base enclosing all of the support, curtain, and hose structure for transport when not in use, and expandable to a full height, fully enclosed shower stall. The shower stall may use a variety of water sources, either by a gravity fed shower bag, or by a pressure fed system. A compartment in the hollow base serves as a waste water collection chamber. Disposal of waste water can be done by either sealing the base and transporting to a waste disposal area, or connecting a hose to the discharge port, and directing the waste water away from the front of the shower, as well as other means of evacuating waste water from the base. The shower stall may also be used as a privacy room for changing clothes or as a restroom stall, when used in conjunction with a portable toilet. The shower stall may also be used as a decontamination unit when used with optional equipment.

18 Claims, 4 Drawing Sheets

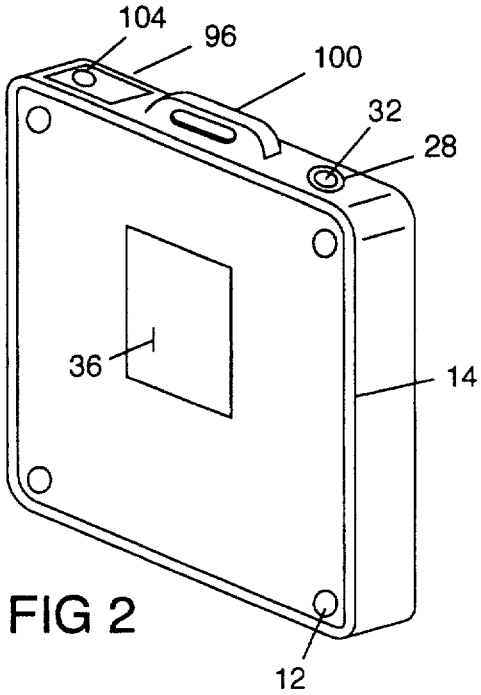
FIG 2
FIG 3B
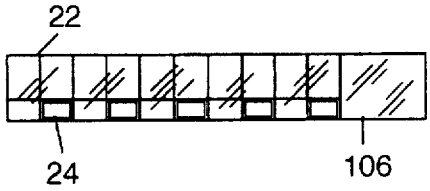
FIG 3A
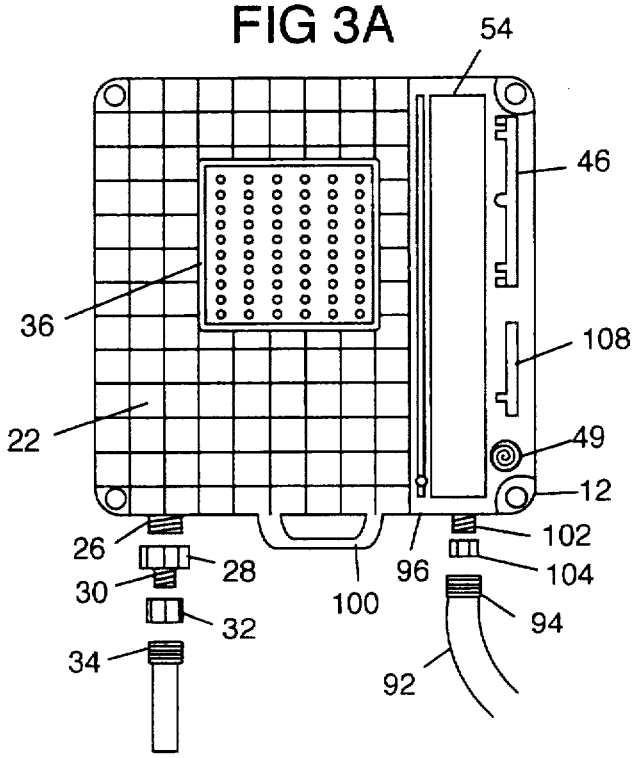
FIG 4
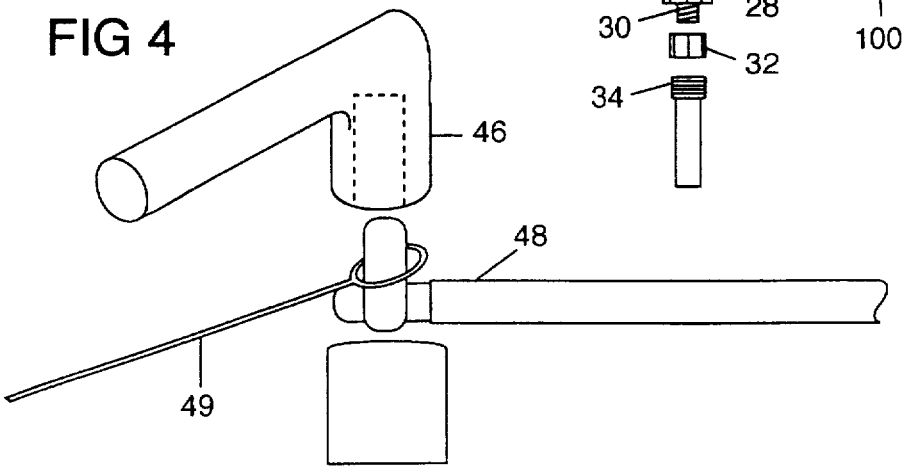

PORTABLE SHOWER/MULTI USE STALL

BACKGROUND OF THE INVENTION

This invention relates to portable self-contained shower stalls that can be utilized as a portable toilet stall, changing room, or as a decontamination unit.

The applications of this invention are virtually unlimited. Whether it is used as a shower unit for camping, rinsing the body after a day's scuba diving, or at a base camp for wilderness firefighting, natural disasters, where either housing or services are lost, or the need of a portable shower, or a private enclosure, especially if water and sewer services were cut off for a considerable amount of time, as well as the military in the field, where there is not an unlimited supply of water.

Another use of this invention is for the camper, boater, construction site, (again the disaster area), or any place that might need a temporary privacy shelter for a portable toilet. For example:(porta poti™), that would sit on top of the base of the shower unit thus insuring privacy while using the facilities.

In addition, with options available, this invention can be used as an emergency shower/decontamination unit. Used by refinery workers, firefighters, or anybody that handles or is exposed to hazardous materials, including rescue divers that may have to go into contaminated water in a remote area where other facilities are not available. With a few of these units you could have a staged decontamination unit.

This invention could be used as a changing room when there are none available or accessible, in all of the above situations or any other situation that may arise.

Portable shower apparatus is widely known in the art. See, for example, U.S. Pat. Nos. 4,453,280 to Greenleaf, 4,539,720 to Westerweller, 4,975,992 to Patterson et al., and 4,413,363 to Troiano. The Portable shower apparatus disclosed in these patents have certain limitations. None of these showers can be sealed to transport waste water in their own bases for disposal to another location. Consequently, you must either be able to dump waste water where the shower stands, or carry a separate container with you to contain the waste water. Another drawback of prior art is that once you shower, you have no access to a dry towel or clothes unless you go outside of the shower to obtain them.

SUMMARY OF THE INVENTION

The instant invention is a collapsible, totally portable, shower stall, which can be connected to any available water supply including its own. It is comprised of the following-:waterproof/resistant walls, support posts, top brace, line for stabilizing the stall, and pegs for securing the line to the ground, which is packed in the storage section of the base when the invention is packed in its portable mode.

To use the invention as a shower, the walls, vertical support rods, curtain support rods, top brace, line for stabilizing the stall, and pegs for securing the line are removed from the storage area of the base. The base is placed on the floor/ground, and the vertical support rods are inserted into the sleeves of the shower curtain. The support rods are then inserted into the corners of the base. The curtain supports are inserted into the sleeves on the top of the shower curtain and then attached to the top of the vertical support rods. The stability lines are then attached to the top of the vertical support rods and secured to the ground by the pegs. The top brace is then attached to the corner supports for added stability of the supports and the shower.

The water supply can be obtained by various means. A pillow-shaped resilient water storage bag filled with either warm or cold water, and attached to the center of top brace. Other water supplies can be used such as a garden hose, fire hose, water fire extinguisher, or utilizing the storage section of the base for water storage, and using a small battery operated pump to flow water. Waste water can be disposed of by gravity flow, suction by means of a vacuum or pump, or sealed in the base for disposal in another location.

This invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

The figures in the drawings are as follows:

FIG. 2 is a perspective view of the base of the portable shower apparatus of FIG. 1 after the shower apparatus has been disassembled and stored in the base, and the drain sealed.

FIG. 3 is a top view of the base, with the top broken away. FIG.3A is showing the base full of waste water and the shower stall in its storage mode. FIG.3B is a side view of the openings in the supports for waste water to pass through.

FIG. 4 is a perspective view of a portion of the shower curtain support frame of the apparatus of FIG. 1 as indicated therein by dashed circle 4.

FIG. 5 is an example of vertical support rods that can be used in regards to this invention.

DETAILED DESCRIPTION

Figure 1:
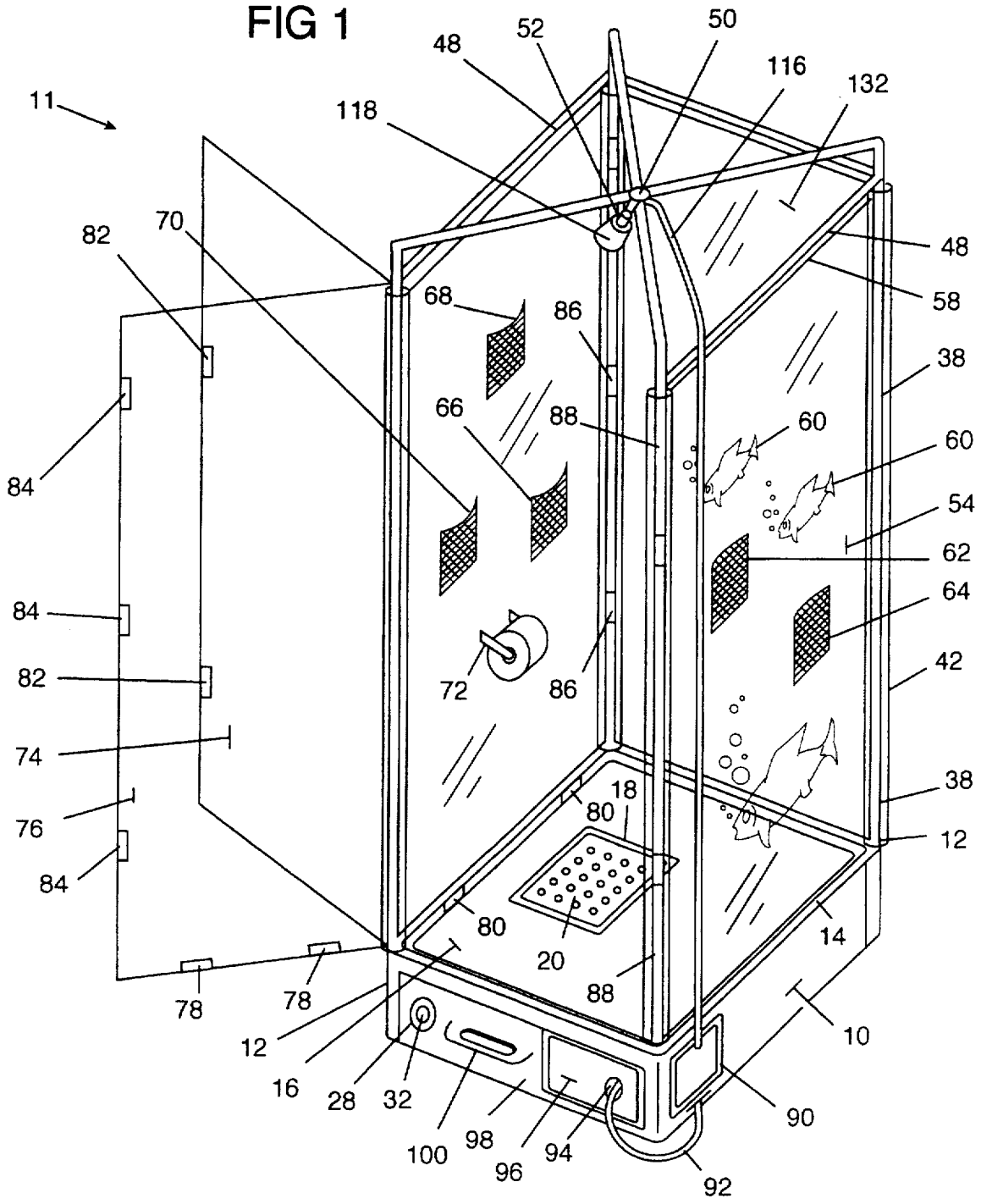
FIG. 1 is a perspective view of the invention as assembled and in use with the shower door and clothes partition door open.

Reference is now made in detail to the drawings. A portable shower system is shown in perspective view in FIG. 1. A base unit 10 with a carrying handle 100, is molded in plastic or other material comprising of a top, bottom, and four sides into one piece with supports inside the base 22. Shown in more detail in FIG. 3A&B, openings at the bottom of the supports 24 facilitate the removal of waste water. The base 10 could be constructed from black material which would absorb sunlight and, by conducting energy through the material, heat water in the storage container 106.

A sealed 96 inner cavity 106 is used for storage, and as a fresh water holding tank if necessary. The top of the shower base 16 is preferably made of a non skid material, to prevent slips and falls from a wet surface. The drain, 20 or inlet aperture is slightly recessed to allow the tongue and groove seal to lay flat. The tongue and groove seal or other sealing means is used to seal said drain opening with a watertight seal. The groove 18 would be molded in the base 10 and the tongue (not shown) would be on the cover 36. The top of the base 16 would be slightly recessed towards the center, 20 with a continuous lip around the edge of the base 14 to keep water from running off the base 10. Recessed in each corner of the base 10 is an upright bore, 12 which runs to the bottom of, but not through the bottom of the base 10. The upright bore 12 provides an attachment means for holding support rods 38.

Figure 5A:
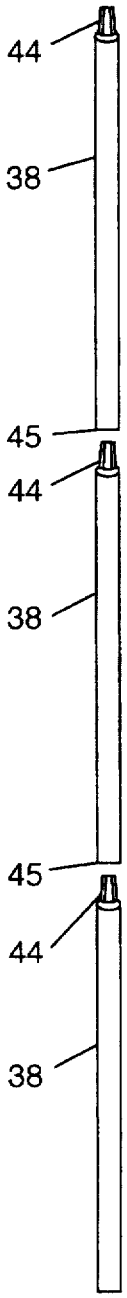
FIG.5A is a series of rod sections that are removably connected by slide-in connectors to form a rod.
Figure 5B:
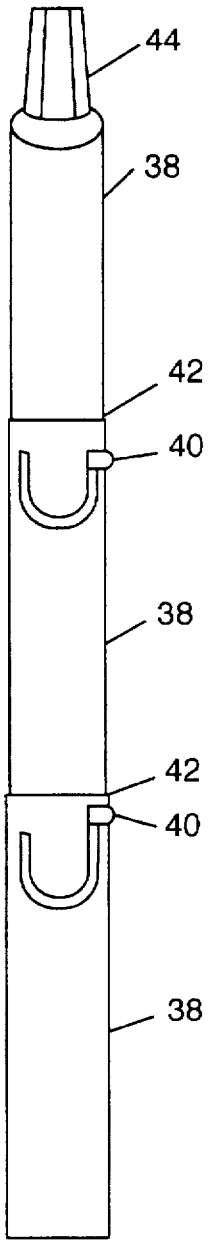
FIG.5B is a telescoping type rod and is secured in place by a locking pin.

The vertical support rods, 38 as shown in detail in FIG. 5B which telescope outward and are secured by a locking pin 40 are removed from the storage compartment 106 and are extended to their full length with the pins 40 locking in place. The pins 40 are slideably received in circular apertures formed in rods 38. The shower curtain 54 is then removed from the storage compartment 106 as shown in detail in FIG. 3B and laid out for the vertical support rods 38 to be inserted in the rod sleeves 42. The shower curtain 54 is made from a water proof/resistant material that is also mildew resistant. Once the vertical support rods 38 are inserted in the sleeves 42 the rods 38 are then inserted into the upright bore 12 on the corners of the base 10. The curtain support rods 48 are then inserted into the sleeves 58 on the top of the curtain 54, thereby providing an attachment means between the support rods 48 and the sleeves 58 of the curtain 54. At this point the curtain support rods 48 are secured onto the tapered top of the vertical support rod 44 as shown in detail in FIG. 4. The stability lines 49 are then secured onto the tapered top 44 of the vertical support rods, 38 and the top brace 46 is secured onto the top 44 of the vertical support rods 38 to make the shower solid. The stability lines 49 are then secured in the ground by pegs 108 as shown in FIG. 3B. The stability lines 49 can be made of various materials. However, they should be a fluorescent or bright color possibly with some type of streamers attached to the line, to avoid tripping over them. The bottom of the shower curtain 54 is secured to the inside lip 14 of the base by Velcro™ brand hook and loop fastners 80 or another type of securing implement.

Figure 6:
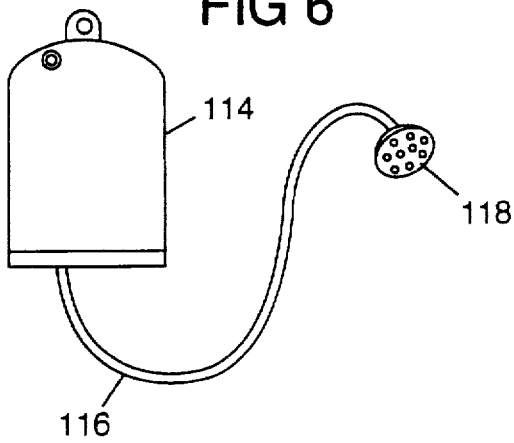
FIG. 6 is the preferred water system for this shower unit using a pillow type water bag with gravity feed. However, any other method disclosed in these drawings or descriptions can be used with this invention.

The top brace 46 has a pin at the center 50 to allow the arms 46 to close together and has a ring and hook on the underside of the pin 52 for attaching either a shower bag for a gravity fed shower shown in FIG. 6 or, a shower head 118 for a pressure fed shower as shown in FIG. 1.

The pockets on the inside wall 66,68,70 of the shower curtain 54 are made of either solid material or mesh. The pockets are to be used for towel, dry clothes or whatever is needed in the stall 11. More or less pockets can be used with varied sizes. The loop 72 in the lower section of the wall is to hold a toilet paper dispenser. This is all kept dry by the inside wall 74 which is waterproof and is attached to the inside wall at the opening of the front of the stall, 11 and closes with the leading edge facing the back wall, 86 and is held in place by Velcro™ hook and loop fastener 82, or some other type of fastener.

The pockets exposed 62,64 are used for soap, shampoo, washcloth, or whatever else the need might be. More or less pockets can be used with varied sizes. The designs on the outside wall 60 are for aesthetic purposes to make the shower more pleasing to the eye, or to convey a message. The outside door 76 is secured to the opposite side 88 by Velcro™ hook and loop fasteners 84 or some other type of fastening device, and may or may not be secured to the base 78 to 80.

The waste water compartment may be sealed with a drain cap or other sealing means. The waste water drain cap is comprised of a cap, 28 male nipple, 30 and cap for the nipple 32. The nipple 30 is threaded with garden hose threads to allow a section of garden hose, 34 or other type of hose to be connected to the waste water discharge 28 shown in detail in FIG. 3B, allowing the waste water being removed to be directed away from the base, 10 and the front of the shower 11, or by capping 32 the discharge, waste water can be taken to a holding facility, and dumped by the large discharge 28,26. The threaded nipple 30 or other connection means may also be attached to a discharge pump. All caps, 28,30, 34,94,104, and 110 that attaches to the base 10, have a gasket on the inside of the cap, (not shown) to allow a water tight seal to the base 10.

The storage side 106 of the base is secured by a tongue and groove seal. The tongue 98 is molded into the base 10, and is grooved on the outside cover 96. On the surface of the outside cover 96 there can be an outlet 102 for fresh water to be stored and used in conjunction with a cap 104. Threaded male nipple 94 (not shown) pickup hose 92 pump, 90 and a delivery hose 116 to the shower head 118 for a pressure shower as shown in FIG.1.

The shower curtain 54 can be altered for use in a hazardous material situation. When the shower units 11 are being used in a staged system, the back wall 132 can be opened to attach itself to the unit behind it (not shown). The shower curtain 54 can be made of a waterproof disposable material when used with a contaminate, the curtain 54 can be disposed of, keeping the rest of the shower 11 for future use with another disposable curtain.

Figure 7:
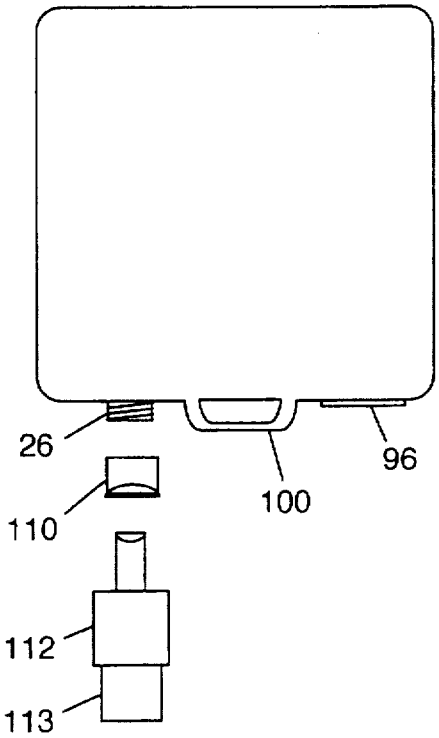
FIG. 7 is a perspective view of the base with an adapter when using a water vacuum or some other type of water suctioning or pump system.

The means of evacuating water can be achieved by attaching the nozzle attachment 110 as shown in FIG. 7 to the base 26 and suctioning the contaminated liquid from the base using a nozzle 112 and hose 113 into a holding container.

Figure 8A:
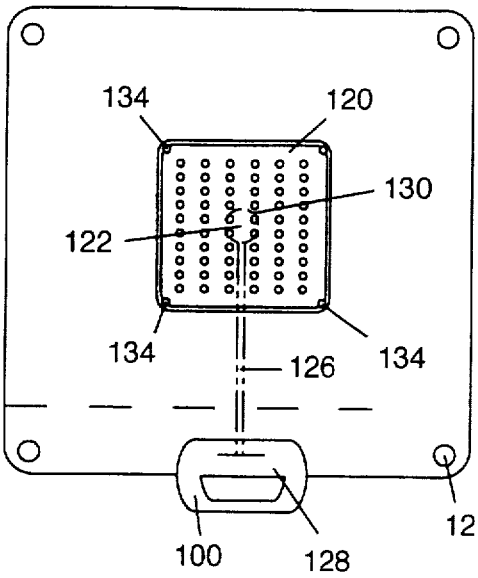
FIG. 8 A–E is a perspective view of the base, using an alternative sealing drain opening with a drainage plate.
Figure 8B:
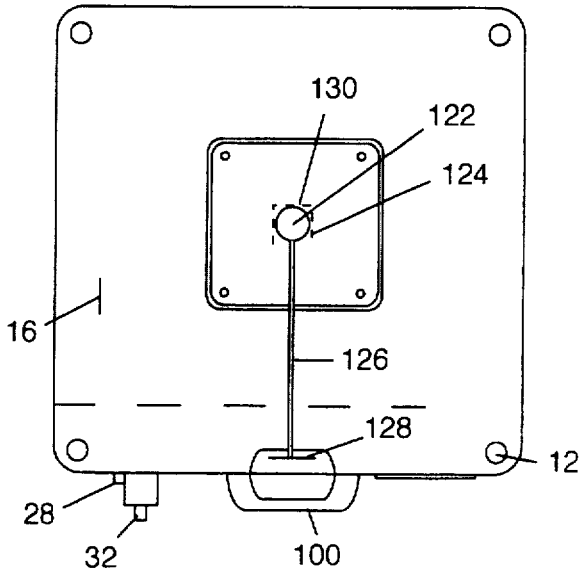
Figure 8D:
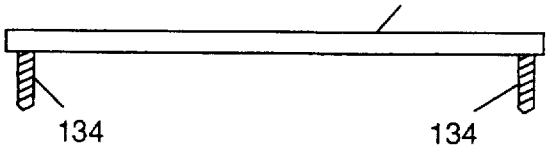
Figure 8C:
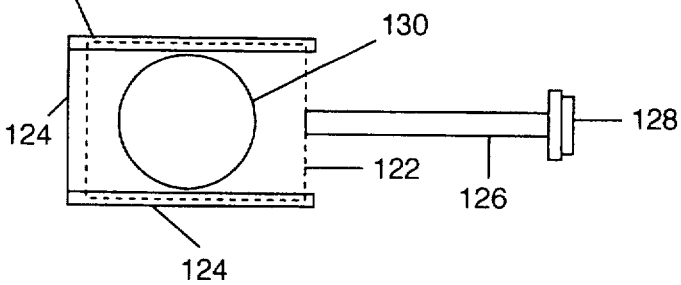
Figure 8E:
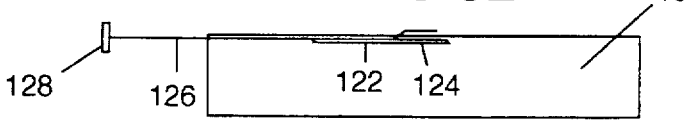

The alternate method to seal the drain on the base 10 is by using a guillotine-type seal, as shown in FIG. 8A,B,C,E. The blade 122 rests on a guide on three sides 124 and has a gasket 130 at the opening to achieve a watertight seal to the blade 122. The blade 122 is attached to a rod 126 that runs to the front of the base 10 and is attached to a handle 128, which could be recessed in front of the handle 100 on the front of the base 10. When the handle is pulled outward, as shown in FIG. 8E, the blade 122 slides away 124 from the mouth of the drain opening, allowing waste water to flow inside the base 10 waste water storage area. When the handle 128 is pushed back in, the blade 122 makes full contact with the seal 130 and creates a watertight seal. The guillotine type seal as shown in FIG. 8E, can be placed on either, the inside of the base 10 (shown), or on the outside of the base 10 (not shown). The area of the drain plate 120 is recessed and held down with screws 134, or another type of fastening device, to attach the plate 120 to the base 10, and create a semi-flat surface. The drain plate 120, like the surface 16 of the base, 10 is constructed of a non-slip material to prevent feet from slipping and falling from a wet surface. There are other ways to seal the drain than just the types illustrated in this art.

Figure 9:
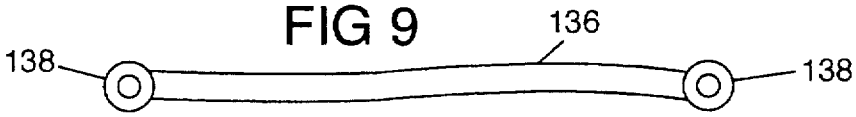
FIG. 9 is an example of a alternate horizontal curtain support rod.

An alternative to the rigid curtain support rod, 48 is a flexible curtain support rod as shown in FIG. 9 consisting of an eye at each end 134, and flexible material in the middle 132.

An alternative of using a shower head, 118 is to place a rigid conduit (not shown), or if more are desired, multiple conduits, parallel to the vertical support rods, 38 and parall el or diagonal from each other with multiple low pressure type spray heads (not shown), fed from a pressure source. To surround the person using the shower with water, the conduit can be attached to the vertical support rods 38 by clamps of some type (not shown).

If desired the pump 90 could be designed to be foot or manually powered so that a source other than electricity would be required to operate the shower. If a powered pump is desired, A/C, D/C, or solar power can be used.

An alternative to having the threaded male nipple 102 on the outside cover, 96 of the storage compartment 106 is to place the nipple on the base, 10 with a pickup hose attached to the inside of the base 10. The pickup hose (not shown) can also be put on the inside of the seal 96 of the threaded nipple 102.

A sealable air vent (not shown) may also be placed on the storage compartment, 106 of the base 10 to allow air to enter the storage compartment 106 while water is being pumped from the compartment 106 to prevent a vacuum from being created in the sealed compartment.

Although the examples given include many specificities, they are intended as illustrative of only some of the possible embodiments and modifications will, no doubt, occur to those skilled in the art. Thus, the examples given should only be interpreted as illustrations of some of the preferred embodiments of the invention, and the full scope of the invention should be determined by the appended claims and their legal equivalents.

I claim:

1. A portable shower stall, comprising:

a hollow base, said base having a first compartment for storage of waste water and a second compartment separate from said first compartment, said second compartment comprising a sealable cavity for storage of fresh water, said base having a recessed top surface with a drain opening, said drain opening being in fluid connection with said first compartment, a plurality of support rods and a support rod attachment means for attaching said plurality of support rods to said base, and a shower curtain and a curtain attachment means for attaching said shower curtain to said plurality of support rods.

2. The portable shower stall of claim 1 wherein said plurality of support rods are collapsible such that said support rods and said shower curtain can be stored within said second compartment when not in use.

3. The portable shower stall of claim 1 wherein said shower curtain further comprises a protective storage pocket being isolated from the interior of said shower stall by a waterproof barrier.

4. The portable shower stall of claim 1 further comprising a sealing means for sealing said drain opening with a watertight seal.

5. The portable shower stall of claim 4 wherein said sealing means comprises a sliding guilloting seal for sealing said drain opening with a watertight seal.

6. The portable shower stall of claim 4 wherein said drain opening has a recessed groove around the periphery of said drain opening and said sealing means comprises a flexible cover having a tongue around the periphery of said cover, said tongue of said cover engaging said groove of said drain opening to form a watertight seal.

7. The portable shower stall of claim 1 further comprising a discharge opening in said base, said discharge opening being in fluid connection with said first compartment.

8. The portable shower stall of claim 7 further comprising a connection means for connecting said discharge opening to a discharge pump.

9. The portable shower stall of claim 7 further comprising a connection means for connecting said discharge opening to a hose.

10. The portable shower stall of claim 9 wherein said hose is a garden hose.

11. The portable shower stall of claim 1 further comprising at least one internal support within said hollow base for supporting said top surface of said base.

12. The portable shower stall of claim 1 wherein said base has four upright bore holes recessed into said base, and wherein said plurality of support rods is four vertical support rods, said four vertical support rods being removably attachable to said base by inserting each of said rods into one of said four upright bore holes.

13. The portable shower stall of claim 12 wherein said four support rods are collapsible such that said support rods and said shower curtain can be stored within said second compartment when not in use.

14. The portable shower stall of claim 13 wherein said first sealing means comprises a sliding guillotine seal for sealing said drain opening with a watertight seal.

15. The portable shower stall of claim 13 wherein said drain opening has a recessed groove around the periphery of said drain opening and said first sealing means comprises a flexible cover having a tongue around the periphery of said cover, said tongue of said cover engaging said groove of said drain opening to form a watertight seal.

16. A portable shower stall, comprising:

a hollow base, said base having a first compartment for storage of waste water and a second compartment separate from said first compartment, said base having a recessed top surface with a drain opening, said drain opening being in fluid connection with said first compartment, a sealing means comprising a sliding guillotine seal for sealing said drain opening with a watertight seal, a plurality of support rods and a support rod attachment means for attaching said plurality of support rods to said base, and a shower curtain and a curtain attachment means for attaching said shower curtain to said plurality of support rods.

17. The portable shower stall of claim 16 wherein said second compartment is for storage of fresh water.

18. A portable shower stall, comprising:

a hollow base, said base having a first compartment for storage of waste water and a second compartment separate from said first compartment, said base having a recessed top surface with a drain opening, said drain opening being in fluid connection with said first compartment, a sealing means for sealing said drain opening with a watertight seal comprising a recessed groove around the periphery of said drain opening and a flexible cover having a tongue around the periphery of said cover, said tongue of said cover engaging said groove of said drain opening to form a watertight seal, a plurality of support rods and a support rod attachment means for attaching said plurality of support rods to said base, and a shower curtain and a curtain attachment means for attaching said shower curtain to said plurality of support rods.

* * * * *